US007039986B2

(12) United States Patent
Glenn et al.

(10) Patent No.: US 7,039,986 B2
(45) Date of Patent: May 9, 2006

(54) VIBRATION ISOLATION MACHINE HANDLE

(75) Inventors: J. Brandal Glenn, Boise, ID (US); Jeff Arnswald, Boise, ID (US)

(73) Assignee: Multiquip, Inc., Carson, CA (US)

( * ) Notice: Subject to any disclaimer, the term of this patent is extended or adjusted under 35 U.S.C. 154(b) by 69 days.

(21) Appl. No.: 10/773,844

(22) Filed: Feb. 5, 2004

(65) Prior Publication Data

US 2005/0172457 A1 Aug. 11, 2005

(51) Int. Cl.
*E01C 19/22* (2006.01)

(52) U.S. Cl. ..... 16/430; 16/110.1; 404/112; 15/DIG. 10

(58) Field of Classification Search ..... 16/110.1, 16/430, 431; 404/112; 15/DIG. 10; 56/DIG. 18
See application file for complete search history.

(56) References Cited

U.S. PATENT DOCUMENTS 481,827 A * 8/1892 Sanford ..... 15/41.1
2,511,160 A * 6/1950 Grobowski ..... 16/437
4,217,677 A 8/1980 Sumikawa
4,232,980 A * 11/1980 Tertinek et al. ..... 404/112
4,609,055 A * 9/1986 Grafstrom et al. ..... 173/162.2
5,052,500 A 10/1991 Ohtsu
5,213,167 A 5/1993 Best et al.
5,273,120 A 12/1993 Chang
5,365,637 A 11/1994 Bodell et al.
5,379,846 A * 1/1995 Wagster et al. ..... 172/15
5,732,602 A 3/1998 Schwartz
5,803,657 A * 9/1998 Hodgson ..... 404/112
6,220,367 B1 4/2001 Masterson et al.
6,267,532 B1 * 7/2001 Persson ..... 404/133.1
6,286,610 B1 9/2001 Berger et al.
6,311,369 B1 11/2001 Ryu
6,412,180 B1 7/2002 Wolf et al.
6,749,365 B1 * 6/2004 Sina et al. ..... 404/133.1

* cited by examiner

*Primary Examiner*—Gary S. Hartmann
(74) *Attorney, Agent, or Firm*—Frank J. Dykas; Dykas, Shaver & Nipper

(57) ABSTRACT

Disclosed is a vibration dampening handle for power tools. It includes a branch handle attached to a main handle, but at least one resilient connection. The upper connection is through a resilient connection, and the lower connection is typically a solid connection.

14 Claims, 2 Drawing Sheets

VIBRATION ISOLATION MACHINE HANDLE

BACKGROUND OF THE INVENTION

1. Field of the Invention

The present invention is a vibration isolation handle for use on power tools, and is more specifically a vibration dampening handle with a vibration dampening connection to a main tool handle.

2. Background Information

Power tools are often operated through a handle that reaches from a standing height to a floor or ground level tool. This can include tools for finishing wet cement, cutting cement, polishing wood floors, sanding wood floors or other types of power tools. Such tools impart considerable vibration to the user through the handle that he/she uses to control the machine.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a handle for use on a walk-behind power tool that isolates and minimizes vibration coming from the power tool. The typical power tool that this would be used on is a walk-behind cement-finishing device that has rotating trowel blades in order to smooth and finish a concrete floor. Other walk-behind power tools could also benefit from a handle with this design, particularly those power tools that are used to work on floors, which could include sanders, buffers, polishers, grinders, and other power tools.

The power tool for use with this handle includes a handle shaft. The handle shaft is attached to the power tool at a first point of attachment. In the case of a cement-finishing tool, the handle shaft is the housing for a trowel angle adjustment linkage. The handle shaft could also serve to contain other control devices for other types of power tools, such as motor speed control, direction of rotation, or other control devices. Attached to the handle shaft is a branch handle, which is parallel with the handle shaft and attaches to the handle shaft in two points, a lower attachment point and an upper attachment point. The branch handle also extends into a second section that has handle grips for a user to grasp in order to control the machine.

In one preferred version of the present invention, the branch handle is made up of two tubes that are parallel with the handle shaft. These include a left handle tube and a right handle tube, with each of these two tubes having a handle grip attached to them. The first portion of these handle tubes is preferably generally parallel to the handle shaft, while a second portion diverges from parallel with the handle shaft to form left and right handle grips.

The handle also includes a resilient member, which is preferably a grommet made of rubber or a rubber like material. The resilient member is mounted in the upper attachment point and serves as a connection between the handle shaft and the branch handle. This has the effect of connecting the two shafts, but does not transfer vibration from the upper part of the handle shaft to the branch handle.

Much of the vibration of the power tool is generated in the upper portion of the handle shaft, so the resilient member prevents the vibration from being transmitted to the user. Although the branch handle is connected at a lower attachment point to the handle shaft, much less vibration is transmitted at this point than further up the handle shaft, where the energy of the power tool has generated more vibration.

In the version of the vibration isolation handle in which the branch handle includes two handle tubes, the upper connection can include a resilient member bracket, which is attached to the handle shaft. This bracket extends between the left and right handle tubes and contains within it the resilient member mounted in the bracket. When the bracket and the resilient member are between the left and right handle tubes, an attachment bolt can pass through the left and right handle tubes and through the center of the resilient member. In this manner, the branch handle can be attached to the handle shaft through the resilient member. The resilient member would typically be a rubber grommet or a device made of rubber like resilient material. This resilient material prevents transmission of vibrations form the handle shaft into the branch handle and through the branch handle to the handle grips and thus the user's hands.

The purpose of the foregoing abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
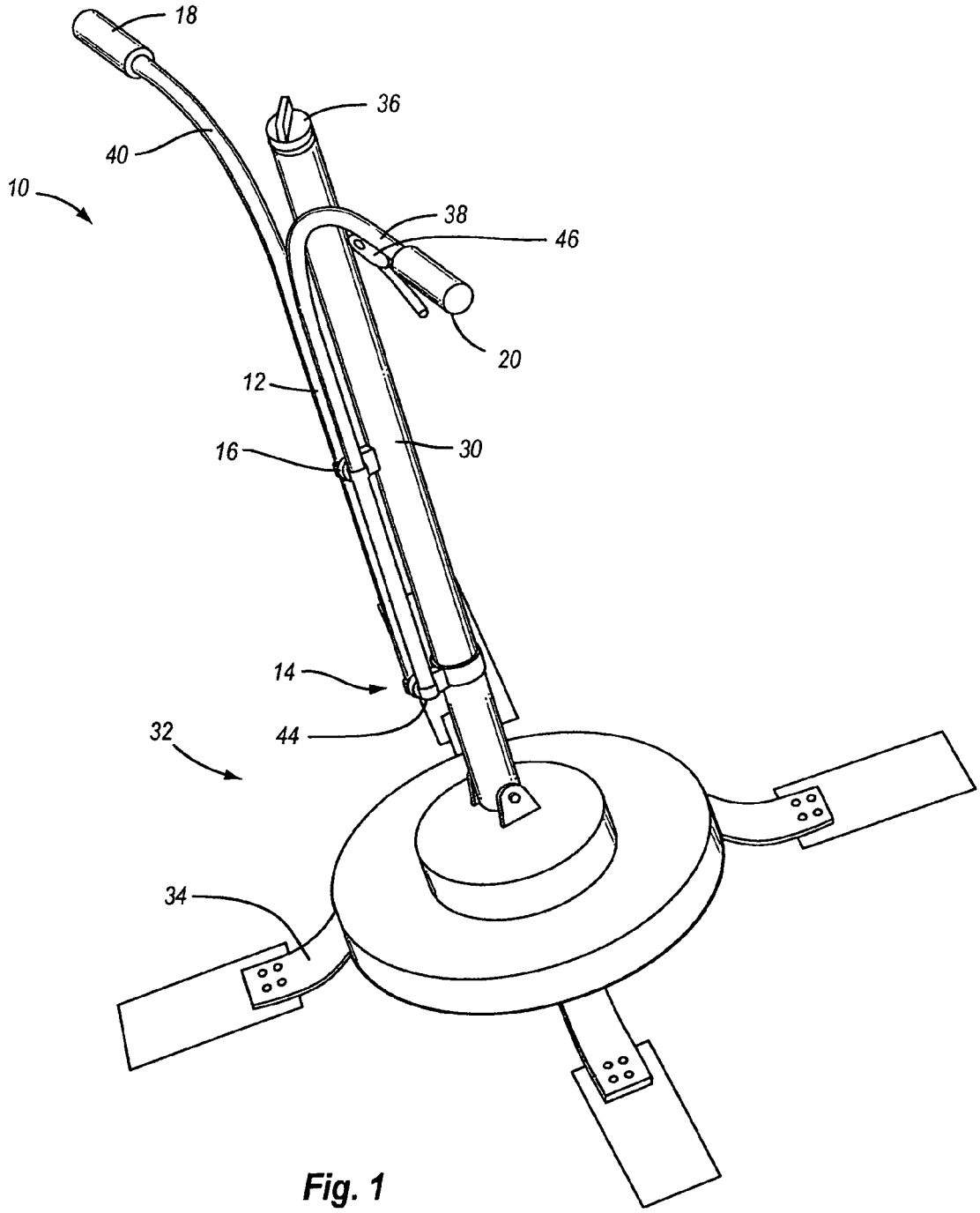
FIG. 1 is a perspective view of the vibration dampening handle.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
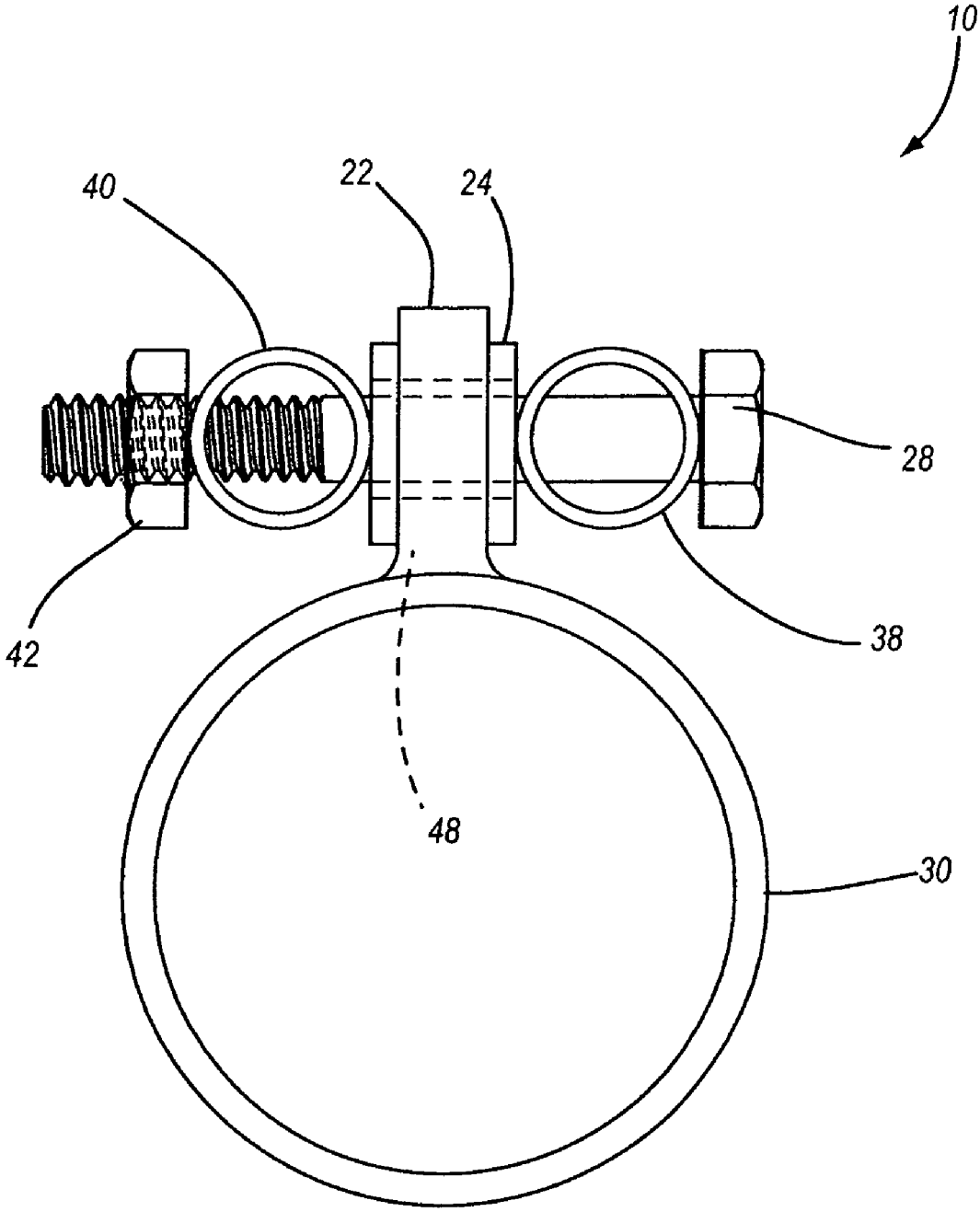
FIG. 2 is a cross section of the connection to the main handle.

FIGS. 1 and 2 show the vibration dampening handle of the present invention. The vibration dampening handle is indicated as 10 and is shown in a configuration for use with a cement finishing machine 32. The cement finishing machine 32 has trowel blades 34, which contact a cement floor during the process of finishing the cement floor. Attached to the cement finishing tool 32 is a main handle 30. In the case of a cement finishing tool 32, the main handle 30 is a steel tube of approximately two inches diameter, and houses a blade pitch adjustment device (not shown), which terminates in a pitch adjustment control knob 36. Rotation of the adjustment control knob 36 changes the angle of the trowel blades 34 to the cement floor.

Although the handle is shown in a configuration for use with a cement finishing tool, other power tools would also benefit with the vibration dampening handle of the invention. This includes floor sanders, buffers, grinders, and other power tools, as well as any tool that generates vibration through a handle.

Along side the main handle 30 is a branch handle 12. The branch handle 12 is attached to the main handle 30 at two points, a lower attachment point 14 and an upper attachment point 16. The branch handle 12 can take a number of configurations, but one that has proven to be effective is when the branch handle consists of two tubes that are parallel to each other and parallel to the main handle 30. The two tubes are a right tube 38 and a left tube 40. In the preferred embodiment of the present invention, the left and right tubes are made of steel and are approximately seven-eighths inch (⅞") in diameter. Approximately midway up on the main handle 30 is located a mounting flange or mounting bracket 22. This is better shown in FIG. 2. Mounting flange 22 is a steel flange that is attached to the main handle 30, and which has a hole passing through it that is approximately one and one-quarter inches (1¼") in diameter.

Mounted inside the mounting flange 22 is a resilient member, or grommet 24. The resilient member 24 also has a hole in its center, which is approximately five-eighths inch (⅝") in diameter. The outside diameter of the resilient member is approximately one and one-quarter inches (1¼") in diameter, and fits snuggly inside the hole of the mounting flange 22. Inside the resilient member is a generally cylindrical spacer 48, which of about ⅝" in OD, and has an ID of about ⅜". As shown in FIG. 2, one way that the branch handle 12 is attached to the main handle 30 is by attachment to the mounting flange 22 through the resilient member 24. In the preferred embodiment, a bolt 28, which is approximately three-eighths inch (⅜"), passes through the left tube handle 40, the right tube handle 38, and through the spacer 48 which is inside the resilient member 24, through the mounting flange 22, and is secured by a nut 42.

The lower attachment point 14, which is shown in FIG. 1, is a simple mechanical attachment of the base of the branch handle 12 to the main handle 30. This is by use of a lower bracket 44 with a bolt that attaches the lower end of the branch handle to the lower bracket 44. A resilient attachment point at the lower end of the handle is also possible, but not as important as the resilient attachment point further up the handle.

In the example shown, a tool throttle control 46 is shown mounted to the right tube adjacent to a right handle grip 20. There is also a left handle grip 18 present. Other tool configurations could have other controls mounted on the handles, such as a brake and clutch. The left and right handles could also be connected to controls so that rotation of the handle grips 18 and 20 results in throttle control, or other tool control functions.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A vibration isolation handle for a power tool, comprising:

a handle shaft attached to said power tool at a first point of attachment;

a mounting flange, attached to said handle shaft, for attachment of a branch handle;

a branch handle, parallel with said handle shaft and attached to said handle shaft at a lower attachment point and an upper attachment point, and including handle grips; and a resilient member in said upper attachment point, mounted to said mounting flange so that connection between said branch handle and said handle shaft is through said resilient member; wherein said resilient member dampens vibration from said power tool, and does not transmit vibration from said handle shaft to said branch handle.

2. The vibration isolation handle for a walk behind power tool of claim 1 in which said branch handle includes a left handle tube and a right handle tube, with a left and a right handle grip attached to said handle tubes.

3. The vibration isolation handle for a walk behind power tool of claim 2, in which said left and right handle tubes include a first portion which is generally parallel with said handle shaft, and a second section which diverges from parallel with said handle shaft, to form said left and right handle grips.

4. The vibration isolation handle for a walk behind power tool of claim 1 in which said resilient member is a rubber grommet.

5. A vibration isolation handle for a power tool, comprising:

a handle shaft attached to said power tool at a first point of attachment;

an upper mounting flange, and a lower mounting flange, attached to said handle shaft, for attachment of a branch handle;

a branch handle, parallel with said handle shaft and attached to said handle shaft at a lower attachment point and an upper attachment point, and including handle grips, said branch handle including a left handle tube and a right handle tube, with a left and a right handle grip attached to said handle tubes;

a resilient member in said upper attachment point, mounted to said mounting flange so that connection between said branch handle and said handle shaft is through said resilient member; wherein said resilient member dampens vibration from said power tool, and does not transmit vibration from said handle shaft to said branch handle.

6. The vibration isolation handle for a walk behind power tool of claim 5, in which said left and right handle tubes include a first portion which is generally parallel with said handle shaft, and a second section which diverges from parallel with said handle shaft, to form said left and right handle grips.

7. The vibration isolation handle for a walk behind power tool of claim 5 in which said resilient member is a rubber grommet.

8. The vibration isolation handle for a walk behind power tool of claim 2, in which said upper connection comprises a resilient member bracket attached to said handle shaft and extending between said left and right handle tubes, with said resilient member mounted in said bracket, and an attachment bolt which passes through said left and right handle tubes and through said resilient member, thereby attaching said branch handle to said handle shaft and isolating said handle grips from vibration from said handle shaft.

9. The vibration isolation handle of claim 1 which further includes a spacer mounted inside said resilient member, through which said bolt passes for connecting said branch handle to said main handle.

10. The vibration isolation handle for a walk behind power tool of claim 1, in which said power tool is configured for work on floors.

11. The vibration isolation handle for a walk behind power tool of claim 1, in which said power tool is configured to finish cement floors.

12. The vibration isolation handle for a walk behind power tool of claim 1, in which said handle shaft contains a control device for controlling the power tool.

13. The vibration isolation handle for a walk behind power tool of claim 12 in which the control device is a trowel angle adjustment linkage, with an adjusting knob available for adjusting the angle of the trowel, and said trowel angle adjustment linkage is for adjusting trowel pitch of cement finishing trowels of said power tool.

14. The vibration isolation handle for a walk behind power tool of claim 1 in which said handle shaft is connected to said power tool by a rigid connection.

* * * * *